US010060141B1

(12) United States Patent
Shaw

(10) Patent No.: US 10,060,141 B1
(45) Date of Patent: Aug. 28, 2018

(54) PORTABLE FLUID STORAGE TANK DESIGN AND SYSTEM

(71) Applicant: Omni Energy Services Corp., Carencro, LA (US)

(72) Inventor: Lawrence J. Shaw, Lake Arthur, LA (US)

(73) Assignee: Omni Energy Services Corp., Carencro, LA (US)

( * ) Notice: Subject to any disclaimer, the term of this patent is extended or adjusted under 35 U.S.C. 154(b) by 0 days.

(21) Appl. No.: 14/689,122

(22) Filed: Apr. 17, 2015

Related U.S. Application Data

(60) Provisional application No. 61/980,839, filed on Apr. 17, 2014.

(51) Int. Cl.
*E04G 1/15* (2006.01)
*E21B 41/00* (2006.01)
*E04G 5/14* (2006.01)

(52) U.S. Cl.
CPC ..... *E04G 1/15* (2013.01); *E04G 5/14* (2013.01); *E21B 41/00* (2013.01)

(58) Field of Classification Search
CPC ..... E04G 1/15
See application file for complete search history.

(56) References Cited

U.S. PATENT DOCUMENTS 2,108,204 A * 2/1938 Lentz ..... B61C 17/02 105/1.3
3,050,330 A * 8/1962 Willson ..... B60P 3/32 296/156
3,709,196 A 1/1973 Hicks
4,064,584 A 12/1977 Funkhouser
4,422,485 A 12/1983 O'Shea et al.
4,708,572 A 11/1987 Kölker
5,653,469 A 8/1997 Wade
6,279,955 B1 * 8/2001 Fisher ..... B60P 3/221 182/127
6,375,222 B1 4/2002 Wade
6,390,325 B1 * 5/2002 Gonzales ..... B60R 3/005 220/1.5
7,699,988 B2 4/2010 McGuire et al.
(Continued)

FOREIGN PATENT DOCUMENTS

WO 01/70597 A1 9/2001
WO 2010070516 A1 6/2010

OTHER PUBLICATIONS

Marion Body Works, Inc., Rescue Fire, Jun. 21, 2013, p. 1, paragraph1.

*Primary Examiner* — Alvin Constantine Chin-Shue
(74) *Attorney, Agent, or Firm* — Lauren J. Rucinski; Robert Devin Ricci; Kean Miller LLP

(57) ABSTRACT

An improved portable fluid storage tank comprising an enclosure having a bottom wall upon which the tank rests, a front or forward end, a back or rear end, a pair of opposed, vertically extending side walls, a top wall, and at least one recessed channel formed in said top wall whereby a walkway is formed to allow an operator to safely maneuver on top of said tank. In a further embodiment, a system of portable storage tanks is described wherein the walkways of two or more said improved portable storage tanks are connected thereby creating a walkway network between said improved portable fluid storage tanks.

16 Claims, 1 Drawing Sheet

(56) References Cited

U.S. PATENT DOCUMENTS

| | | | | |
|---|---|---|---|---|
| 7,997,623 | B2 | 8/2011 | Williams | |
| 8,113,314 | B2 * | 2/2012 | Kennedy | B60R 3/02 182/62.5 |
| 8,215,516 | B2 | 7/2012 | Kaupp | |
| 8,376,084 | B2 | 2/2013 | Castagno et al. | |
| 8,496,270 | B2 * | 7/2013 | Nothof | B60P 3/00 220/562 |
| 8,523,233 | B2 * | 9/2013 | Markham | B60P 3/221 280/839 |
| 8,745,799 | B1 * | 6/2014 | Thomasson | B65G 69/22 14/31 |
| 8,801,041 | B2 * | 8/2014 | Barrett | B60R 3/005 137/267 |
| 2003/0020253 | A1 * | 1/2003 | Albert Bosman | B60R 3/005 280/164.1 |
| 2007/0272697 | A1 | 11/2007 | Ewen | |
| 2008/0099282 | A1 * | 5/2008 | Boroski | E02F 9/0833 187/203 |
| 2012/0299283 | A1 | 11/2012 | Harrell | |
| 2013/0001224 | A1 | 1/2013 | Payne | |
| 2013/0119651 | A1 | 5/2013 | Conny et al. | |
| 2014/0217716 | A1 * | 8/2014 | Reynolds | B60P 3/2235 280/830 |

* cited by examiner

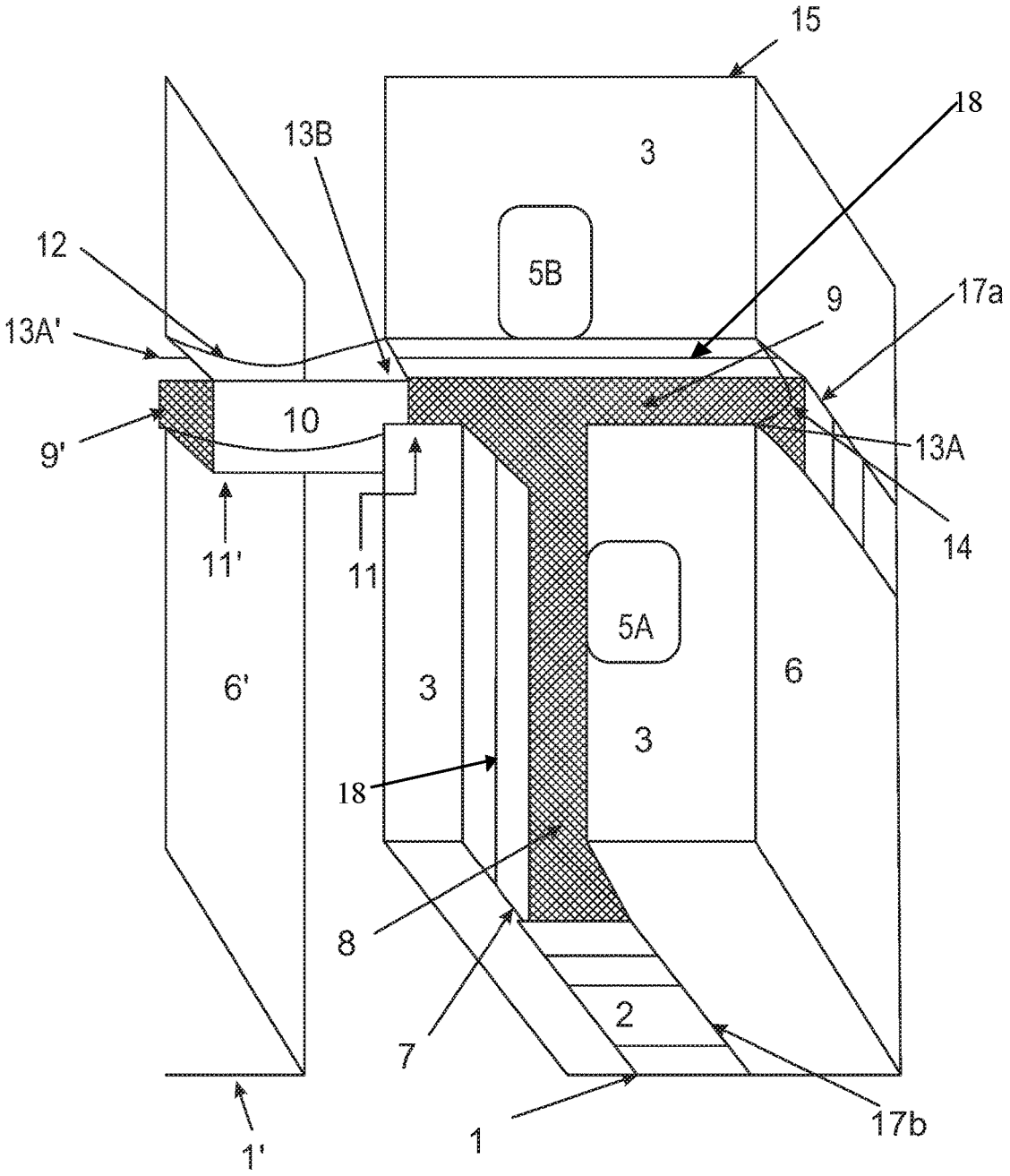
15
18
13B
3
5B
12
9
17a
13A'
10
9'
13A
14
11'
11
5A
6'
3
6
3
18
8
2
7
17b
1'
1

PORTABLE FLUID STORAGE TANK DESIGN AND SYSTEM

CROSS REFERENCE TO RELATED APPLICATIONS

This application claims priority to U.S. Provisional Application No. 61/980,839, which was filed on Apr. 17, 2014.

STATEMENT REGARDING FEDERALLY SPONSORED RESEARCH OR DEVELOPMENT

Not Applicable.

REFERENCE TO A "SEQUENCE LISTING," A TABLE, OR A COMPUTER PROGRAM

Not Applicable.

BACKGROUND OF THE INVENTION

Many industries and operations such as drilling and fracturing operations often require the use of large amounts of fluids. For example, fracturing a gas well in a shale formation often requires a large volume of fracturing fluids. Given the great deal of expense in the fracturing process, industry practice is to accumulate a large volume of fracturing fluids at the well site prior to commencing the fracturing process, thereby allowing for a continuous procedure. To accumulate the requisite volume of fracturing fluids, portable fluid storage tanks are used. The use of these tanks, sometimes referred to as frac tanks or mobile oil field tanks, is well known in the art.

In order to pool the requisite volume of fluids, it is typical for multiple portable storage tanks to be positioned side-by-side and are sometimes joined together with conduit or other tubing, thus creating a reservoir of the required fluid for storage and dispensing purposes. Various liquids are known to the art to be pooled in this manner, including, but not limited to water, a proppant, fracturing liquids, drilling mud, crude oil, as well as various other liquids or slurries.

The applicable industries are constantly striving to enhance the safety of their workers in the field. During normal drilling operations, it is typical for operators to have to ascend to the top of the portable storage tanks for various reasons and to move from one tank to the next. Because the storage tanks are kept on the operation site, they are often exposed to the elements such as rain, ice, and snow, as well as to the fluids stored in the tanks themselves. This exposure has the propensity to make the tanks slick or slippery, thus adding additional risk of injury to the workers who may slip and fall from the large tanks while walking on top of a tank or moving from one tank to the next.

There exists in the prior art attempts to render it easier for workers to move from one tank to the next via external platforms which merely cover the tubing normally positioned on one side of the portable storage tank. However, the prior art utilizes external additions to the portable storage tanks such as stair platforms to alleviate the safety risks posed by the operator need transcending the tubing to move from one tank to the next. The prior art does not address the dangers posed to the operator as he transcends the top of the tank itself.

Thus, there exists significant room for improvement in the art for overcoming these and other shortcomings of conventional portable storage tanks.

SUMMARY OF THE INVENTION

It is therefore an object of the invention to provide a portable fluid storage tank which adds greater safety to operators which need to climb to and maneuver on the top of the portable fluid storage tank. It is a further object of the invention to facilitate a safer means for the operator to transfer from one portable fluid storage tank to the next when two or more portable storage tanks are situated next to each other, either juxtaposed or length-wise.

The invention therefore provides an improved portable fluid storage tank comprising an enclosure having a bottom wall upon which the tank rests, a front or forward end, a back or rear end, a pair of opposed, vertically extending side walls, a top wall, and at least one recessed channel formed in said top wall whereby a walkway is formed. Furthermore, a system of at least two or more improved portable fluid storage tanks is described herein, wherein the walkways of said at least two or more improved portable fluid storage tanks are connected via connector devices thereby creating a walkway network between at least two or more improved portable fluid storage tanks.

DESCRIPTION OF THE DRAWINGS

The drawings constitute a part of this specification and include exemplary embodiments of the Improved Portable Fluid Storage Tank Design and System, which may be embodied in various forms. It is to be understood that in some instances, various aspects of the Improved Portable Fluid Storage Tank Design and System may be shown exaggerated or enlarged to facilitate an understanding of the invention. Therefore the drawings may not be to scale.

FIG. 1 is a drawing depicting an embodiment of the Improved Portable Fluid Storage Tank Design and System which shows an embodiment of the improved portable storage tank comprising a longitudinal walkway and a cross walkway. A connector device mates the cross walkway of a first improved portable fluid storage tank and the cross walkway of the second improved portable fluid storage tank thereby creating a walkway network between the two.

DETAILED DESCRIPTION

The subject matter of the present invention is described with specificity herein to meet statutory requirements. The terms and expressions which have been employed herein are used as terms of description and not of limitation, and there is no intention, in the use of such terms and expressions, of excluding any equivalents of the features shown and described or portions thereof, but it is recognized that various modifications are possible within the scope of the invention claimed. Rather, the claimed subject matter might be embodied in other ways to include different features or combinations of features similar to the ones described in this document, in conjunction with other present or future technologies.

Referring to FIG. 1 of the drawings, an embodiment of the improved portable fluid storage tank design is shown as a frac tank wherein one said frac tank is shown juxtaposed to the cross section of a second frac tank. As embodied in FIG. 1, the frac tank comprises generally an elongated enclosure having a bottom wall 1 upon which the tank rests, a front or forward end 2, a back or rear end 15 (not depicted), a pair of opposed, vertically extending side walls 6 and 16 (16, not depicted), a top wall 3, a longitudinal walkway 8 formed from a channel recessed from the top wall and through front end 2, and a cross walkway 9 formed from a channel recessed from the top wall and through the side walls 6 and 16. The terms front, forward, back or rear are dependent on the angle of the viewer and should not be deemed to limit the scope of the invention or any claims.

In the present embodiment, the frac tank comprises a longitudinal walkway 8 which is a recessed channel through top wall 3 and front end 2 in which an operator can safely maneuver such that the operator can access viewing window or access port 5A as needed. In the presently depicted embodiment, longitudinal walkway 8 extends from longitudinal walkway opening 7 to a point wherein longitudinal walkway 8 intersects with cross walkway 9. Cross walkway 9 is a channel recessed from top wall 3 and through side walls 6 and 16 at cross walkway openings 13A and 13B in which an operator can safely maneuver such that the operator can access viewing window or access port 5B as needed. In the current embodiment, longitudinal walkway 8 and cross walkway 9 intersect at a substantially ninety degree angle forming a T-shape.

Multiple configurations for the walkway are conceivable so long as the tank comprises at least one walkway. For example, additional embodiments can be conceived wherein either a longitudinal walkway or a cross walkway are utilized, wherein at least one longitudinal walkway is utilized, wherein at least one cross walkway is utilized, or where at least one longitudinal cross walkway and at least one cross walkway is utilized. It is likewise conceivable that a frac tank could be utilized which does not distinguish between longitudinal and cross walkways, such as in the case of a substantially cubed frac tank. It is also conceivable that either or both the longitudinal or cross walkways could span the entire top wall, either from front end to back end (longitudinal) or side wall to side wall or that either or both do not cross the entire top wall, only partially spanning the top of the tank. In at least one embodiment, the recessed channel of either or both the longitudinal walkway and/or the cross walkway is recessed to a depth that correlates with the center of mass of a typical operator. For example, in an embodiment, the recess is between 1-5 feet deep; preferably between one and a half to three feet deep. In additional embodiments, the recessed channels (walkways) are covered with a non-slick surface, material or mat (each or all, a "non-slick coating") to help prevent the operator from slipping on the tank. In an additional embodiments, safety railings 18 including but not limited to guide rails, balusters, chains, ropes, cords or combinations thereof can be added to at least one side of the walkways in order to offer additional safety measures. Such safety measures can be either permanently or removable attached to the tank.

It would be conceivable that a climbing means 16*a,b* as is typical in the art would be connected to either or both the longitudinal walkway opening 7 or crosswalk opening 13A, as applicable to the particular embodiment and needs of the operator, so as to allow an operator to enter into either the longitudinal walkway 8 or the cross walkway 9. Such climbing means includes, but is not to be limited to, stairs and ladders which can either be permanently or removably connected to the frac tank.

It is typical practice when multiple frac tanks are to be used on a drilling site for them to be positioned substantially juxtaposed to each other in rows. Typically, an operator must climb up and down several frac tanks for various purposes such as to view into the access ports located on the top of the tank. As embodied in FIG. 1, a connector device 10 is used to mate the cross walkway 9 of the first frac tank with the cross walkway 9' of the second frac tank, thereby creating a continuous walkway between the two frac tanks. In at least one embodiment, connector device 10 acts as a bridge and spans from cross walkway opening 13B to cross walkway opening 13A'. As shown in FIG. 1, no connector device is connected from or to cross walkway opening 13A. When a walkway opening such as cross walkway 13A remains open, i.e., the walkway is not connected to a walkway on another tank via a connector device thereby creating a continuous path, an additional walkway safety guard such as cross walkway safety guard 14 can be utilized to prevent or at least inhibit the operator from falling from or passing through the walkway opening. Several objects can be used as safety guards, including, but not limited to, chains, ropes, cords, metal poles, guard railings, arm bars or detachable walls.

A series of connector devices can be used to mate multiple walkways, thereby creating a walkway network or direct path by which an operator can freely and safely travel amongst the multiple frac tanks. It is to be readily understood that a connector device could likewise be used to connect two or more cross walkways, two or more longitudinal walkways, or a combination of at least one cross walkway and at least one longitudinal walkway. It should be readily apparent from this disclosure that an added benefit of the present invention removes the need for each frac tank to have a separate climbing means, thus limiting costs and required storage space. For example, a system can be set up in which multiple frac tanks are connected devices. In such a system, it is conceivable that a climbing means is connected to only one of the frac tanks or that climbing means are attached to at least one frac tank as convenience dictates.

Multiple devices can be used as a connector device so long as the device is capable of spanning the distance between the first and second frac tanks such that a continuous walkway is formed between the two frac tanks by a bridging or cat-walk like apparatus. By way of illustrative example only, the bridging or cat-walk like apparatuses which could comprise the connector device could include but should not be limited to planks, boards, wood or metal beams. In a preferred embodiment, the connector device is capable of supporting the weight of the operator crossing between the two frac tanks. In the present embodiment, connector device 10 is a gangplank-like structure which is connected substantially near the cross section of side wall 16 and cross walkway opening 13B via connector device attachment means 11 which is a hinge in the depicted embodiment. In an additional embodiment, the second frac tank will also utilize a separate device securing means (not depicted) to secure the connector device in place when it is deployed. Such means may include, but should not be limited to latches, bolts, screws, weights, or other means of removably securing the connector device in place when needed. It is further conceivable that a connector device can be laid between the two walkways without any external securing means, such as wherein the fit of the connector device in the walkways is sufficient to adequately secure the connector device in place.

For added safety to the hypothetical operator in the depicted embodiment, at least one catwalk safety guide 12 can be connected between said first and second frac tanks that will run substantially parallel to the connector device. In one or more embodiments, the catwalk safety guide 12 can include, but is not to be limited to, chains, ropes, guiderails, or can even include ballast like structure attached solely to the connector device itself.

As previously stated, in a typical operation two or more frac tanks will be stored on site and connected via connector devices to create a walkway network. During normal operations, an operator would enter either longitudinal walkway 8 or cross walkway 9 via the climbing means (not depicted) attached thereto. Once the operator has entered one of the walkways, he is free to move about the top of the tank through the walkways in order to access the viewing ports or access ports 5 in order to conduct his intended purpose. Once the task is completed on the first frac tank, the operator can then use the walkway network formed between the walkways of two or more tanks via one or more connector devices to access additional frac tanks as needed. Once the operator's tasks are completed on all frac tanks, the operator will then descend via a climbing device connected to the walkway network.

A person having ordinary skill in the art would readily appreciate multiple embodiments of the present invention in light of this disclosure. For example, in one embodiment, the portable fluid storage tank is a trailer tank which further comprises a rear axle affixed to the tank at or near the rear end. In additional embodiments, inlets for hoses, tubes or other conduits are formed in at least one of the walls so as to allow for access to the enclosure and/or the enclosure's contents.

For the purpose of understanding the improved portable fluid storage tank design and system, references are made in the text to exemplary embodiments of an improved portable fluid storage tank design and system, only some of which are described herein. It should be understood that no limitations on the scope of the invention are intended by describing these exemplary embodiments. One of ordinary skill in the art will readily appreciate that alternate but functionally equivalent components, materials, designs, and equipment may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

Reference throughout this specification to features, advantages, or similar language does not imply that all of the features and advantages that may be realized should be or are in any single embodiment. Rather, language referring to the features and advantages is understood to mean that a specific feature, advantage, or characteristic described in connection with an embodiment is included in at least one embodiment. Thus, discussion of the features and advantages, and similar language, throughout this specification may, but do not necessarily, refer to the same embodiment.

Furthermore, the described features, advantages, and characteristics may be combined in any suitable manner in one or more embodiments. One skilled in the relevant art will recognize that the improved portable fluid storage tank design and system may be practiced without one or more of the specific features or advantages of a particular embodiment. In other instances, additional features and advantages may be recognized in certain embodiments that may not be present in all embodiments.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment.

It should be understood that the drawings are not necessarily to scale; instead, emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change to the basic function to which it is related.

The invention claimed is:

1. A portable storage tank comprising an enclosure wherein said enclosure comprises a bottom wall upon which the tank rests, a front or forward end, a back or rear end, a pair of opposed, vertically extending side walls, and a top wall, wherein at least one recessed channel that is between one and five feet deep is formed by extending into said top wall whereby said at least one recessed channel forms a walkway;

wherein the at least one recessed channel comprises a horizontal recessed channel spanning from and through one side wall to the other creating an opening in said side walls, and a second at least one recessed channel comprises a longitudinal recessed channel spanning from and through the rear wall creating an opening in said rear wall, and at least partially across the top wall towards the front wall, wherein the horizontal and longitudinal recessed channels intersect.

2. The portable storage tank of claim 1 wherein the top wall further comprises at least one access portal in proximity to said walkway.

3. The portable storage tank of claim 1 further comprising a climbing means attached to said portable storage tank in proximity to said opening.

4. The portable storage tank of claim 1 wherein at least a portion of the at least one a recessed channel is lined with a non-slick coating.

5. The portable storage tank of claim 1 wherein at least a portion of the at least one recessed channel is lined with a safety railing.

6. The portable storage tank of claim 1 wherein a connector device is either permanently or removable attached to the at least one recessed channel.

7. The portable storage tank of claim 1 further comprising a safety railing removably attached across said opening when said opening is not in use.

8. A system of portable storage tanks comprising at least two portable storage tanks, wherein each said portable fluid storage tanks comprises a bottom wall upon which the tank rests, a front end, a back end, a pair of opposed, vertically extending side walls, a top wall, and at least one recessed channel that is between one and five feet deep formed in said top wall, wherein the at least one recessed channel comprises a horizontal recessed channel spanning from and through one side wall to the other and a second at least one recessed channel comprises a longitudinal recessed channel spanning from and through the rear wall at least partially across the top wall towards the front wall, wherein the horizontal and longitudinal recessed channels intersect, whereby a walkway through said portable storage tank is formed; wherein the walkway of each at least two portable storage tanks is connected creating a walkway network.

9. The system of portable storage tanks of claim 8 wherein at least one said portable storage tank further comprises a climbing means connected to the at least one recessed channel in communication with the walkway network.

10. The system of portable storage tanks of claim 8 further comprising at least one connector device which connects the walkways of said at least two portable fluid storage tanks thereby forming the walkway network between said at least two portable fluid storage tanks.

11. The system of portable storage tanks of claim 10 wherein the connector device is either removably or permanently attached to at least one portable storage tank.

12. The system of portable storage tanks of claim 8 wherein at least a portion of the walkway network is coated with a non-slick surface.

13. The system of portable storage tank of claim 8 further comprising a walkway safety guard traversing at least a portion of the walkway between two portable storage tanks.

14. The system of portable storage tanks of claim 11 wherein the connector device is permanently attached to one portable storage tank and removably attachable to a second portable storage tank.

15. The system of portable storage tanks of claim 10 further comprising wherein at least one said portable storage tank further comprises a climbing means connected to the at least one recessed channel in communication with the walkway network.

16. The system of portable storage tanks of claim 8 wherein a safety railing is attached along the walkway of at least one portable storage tank.

* * * * *